United States Patent [19]

Loffelman et al.

[11] 3,986,971

[45] Oct. 19, 1976

[54] 2,4-DIISOCYANATO-6-HALO-s-TRIAZINES AS PEROXYGEN BLEACH ACTIVATORS

[75] Inventors: Frank Fred Loffelman, Somerville; Robert Edward Misner, Piscataway, both of N.J.

[73] Assignee: American Cyanamid Company, Stamford, Conn.

[22] Filed: Nov. 25, 1975

[21] Appl. No.: 635,199

[52] U.S. Cl. ..... 252/102; 8/111; 252/186; 260/610 R; 423/272; 252/99

[51] Int. Cl.[2] ..... C11D 3/395; C11D 7/54; D06L 3/02

[58] Field of Search ..... 252/186, 102, 98, 99; 8/111; 423/272, 273; 260/610 R, 610 A

[56] References Cited

UNITED STATES PATENTS

| | | | |
|---|---|---|---|
| 3,907,698 | 9/1975 | Loffelman et al. | 252/102 |
| 3,912,648 | 10/1975 | Brady et al. | 252/102 |

*Primary Examiner*—Benjamin R. Padgett
*Assistant Examiner*—Irwin Gluck
*Attorney, Agent, or Firm*—John L. Sullivan

[57] ABSTRACT

Diisocyanate halotriazine compounds of the formula:

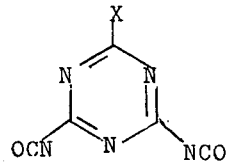

wherein X is a halogen atom are bleach activators which have high bleaching activity at low temperatures in peroxygen salt bleach compositions and do not appreciably change the shade of cotton dyed with many classes of dyes, particularly Vat Blue 6.

5 Claims, No Drawings

2,4-DIISOCYANATO-6-HALO-S-TRIAZINES AS PEROXYGEN BLEACH ACTIVATORS

This invention relates to improved bleaching compositions comprising hydrogen peroxide or a hydrogen peroxide-releasing compound and, as an activator for the peroxide-releasing compound, a diisocyanate halotriazine compound represented by the formula:

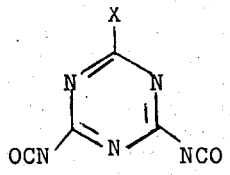

(I)

where X is a halogen atom.

Although the diisocyanate halotriazine compounds defined above are derivatives of s-triazine, similarly substituted derivatives of unsymmetrical triazine are also contemplated as activators for the bleach compositions of this invention.

The use of certain halotriazine derivatives as peroxygen salt bleach activators is disclosed in a copending application, Ser. No. 489,015, now U.S. Pat. No. 3,947,372, of Frank Fred Loffelman (one of the present applicants) and Thomas E. Brady. Perborate bleaching compositions containing the halotriazine derivatives described in that application will remove a greater percentage of stains from a textile material than the same compositions without the activator. However, many peroxygen bleaching compositions containing such activators have not proved satisfactory because they cause significant shade changes on cotton fabrics dyed with many dyes, particularly Vat Blue 6, a major colorant for cotton and cotton/polyester blends.

In accordance with the present invention, it has now been found that the diisocyanate halotriazine compounds defined by Formula I above are highly effective activators for peroxygen bleaching compositions and at the same time cause little or no shade change on cotton dyed with Vat Blue 6.

The activator compounds of the invention can be prepared by the method shown in U.S. Pat. No. 3,732,223, issued on May 18, 1973, to van Gizycki et al. involving the reaction of oxalyl chloride with 2,4-diamino-6-chloro-s-triazine or the 6-bromo or 6-fluoro analog thereof.

An additional advantage of the compositions of the invention is the provision of dry oxygen bleaching compositions which not only exhibit good bleaching activity at relatively low-water temperatures, but also are safer and easier to handle than liquid bleach products. They are relatively safe for all fabrics as well as for dyes thereon, for human and animal hair bleaching compositions, and exhibit germicidal activity. In addition, the compositions are useful for bleaching ground wood pulp.

The bleaching compositions of the invention contain the activating compound and the hydrogen peroxide releasing compound in a molar ratio ranging from about 1:1 to about 1:10, respectively, with a preferred range of about 1:1 to 1:3. The actual ratio of activator to bleach can, of course, be varied widely for varying applications.

The oxygen bleaches useful in these bleaching compositions are hydrogen peroxide and organic peroxides and inorganic peroxygen salts that liberate hydrogen peroxide in water. Examples of peroxide bleaching compounds are urea peroxide, benzoyl peroxide, methyl ethyl ketone peroxide, and the like. Examples of inorganic peroxygen bleaching compounds are alkali metal perborates, percarbonates, perphosphates, persulfates, monopersulfates, and the like. Mixtures of two or more bleaching compounds can, of course, be used if desired.

Although the various peroxide releasing compounds as mentioned above may be used in the compositions of the invention, preferred peroxide releasing compounds are sodium perborate (for economic considerations) and sodium percarbonate (for ecological considerations).

The activated bleach compositions of the invention are useful for bleach applications for various substrates including fabrics, particularly when incorporated with detergent compositions for household or commercial laundering purposes. A most important property of such detergent compositions is the ability to remove stains, including food stains, such as those of coffee, tea, wine and the like as well as to maintain purity of white in uncolored textiles. Aside from food stains, soiling in general may be removed such as grass stains, urine, and the like.

In addition to the detergent, peroxygen releasing compound and peroxygen bleach activator, such detergent compositions may contain other optional additives such as germicides, fungicides, enzymes, optical brighteners, colorants, perfumes, thickeners, emulsion or suspension stabilizers, and the like, including "builders", such as sodium phosphate, salts, carbonates, silicates, and the like as usually encountered in the art.

The detergent component of such activated bleach compositions may be any of the conventional types such as anionic, cationic, nonionic or amphoteric.

Examples of typically suitable anionic detergents includes the alkali metal or alkaline earth metal salts of higher alkylbenzene sulfonates, olefin sulfonates, higher alkyl sulfates and higher fatty acid monoglyceride sulfates.

Examples of typically suitable cationic detergents include tetraalkyl ammonium salts in which one of the alkyl groups contains approximately 12 to 18 carbons such as dedecyltrimethylammonium chloride or ethyldimethyloctadecylammonium methosulfate.

Examples of suitably typical amphoteric detergents are those detergent compounds possessing both cationic and anionic sites and include, for example, amino fatty acids, such as dimethylaminopropionic acid and iminodifatty acids, such as methyliminodilauric acid.

Examples of typical nonionic detergents include polyglycol ethers of alkanol amides of higher fatty acids and also polyglycol ethers of higher alkanols and higher fatty acids.

Bleaching compositions may generally be used also for their germicidal properties in various applications for control of microbial growth. Applications may be made to any surface or substrate where such control is desired.

The treatment of swimming pool water and swimming pool surfaces with the compositions of the invention is especially efficacious since the usually lower temperatures of these environments prevent effective use of other antimicrobial agents. A related utility is the treatment of water supplies to render the same fit for human consumption or for industrial use, such as the sanitization of field water for consumption by military personnel or the treatment of industrial process water so it can be reused in industrial processes or by the surrounding community. The compositions also may be employed in admixture with detergents for use as home or industrial germicidal detergents, or in hair bleaching compositions containing peroxygen compounds.

The following examples and tests will serve to illustrate the invention.

EXAMPLE 1

Evaluation of 2,4-Diisocyanato-6-Chloro-s-Triazine As Activator for Sodium Perborate A bleaching composition using 2,4-diisocyanato-6-chloro-s-triazine and sodium perborate tetrahydrate in a mole ratio of 1:2, respectively, was prepared and its bleaching effectiveness determined by the following test procedure.

Five-gram swatches of desized, 80 × 80 cotton fabric are stained with tea in the following manner. Five tea bags are placed in one liter of water and boiled for five minutes. The swatches are then immersed in the tea and the boiling is continued for another five minutes. The swatches are then removed from the tea, wrung out, dried at 200°–215° F., rinsed in cold water and again dried.

Two of the stained cotton swatches are placed in a stainless steel Terg-O-Tometer manufactured by U.S. Testing Company. One liter of distilled water at 120° F. is introduced along with one 5-gram swatch of 80 × 80 cotton fabric dyed with Vat Blue 6 and seven 5-gram swatches of unstained 80 × 80 cotton fabric to provide a typical household washing machine water-to-cloth ratio of about 20 to 1. Then 2.0 grams of anionic detergent available commercially as "Tide" is added, followed by 0.30 gram sodium perborate tetrahydrate and 0.198 gram of 2,4-diisocyanato-6-chloro-s-triazine. The Terg-O-Tometer is operated at 100 cycles per minute for 15 minutes at a temperature of 120° F. The swatches are then removed, rinsed with cold water and dried at room temperature.

Both before and after laundering, reflectance readings of the swatches are taken on a Hunter Model 25 M Reflectometer with a blue filter. The swatches are backed with a white porcelain plate and read once on both sides. Fluorescent effect is excluded from all readings.

The reflectance readings are averaged and the percent stain removal is obtained in accordance with the following formula in which R is the symbol for reflectance:

$$\text{Total \% stain removal} = \frac{R(\text{Bleached}) \text{ minus } R(\text{Stained})}{R(\text{Unstained}) \text{ minus } R(\text{Stained})} \times 100$$

A control run is also made using the described amounts of the detergent and sodium perborate tetrahydrate with no activator.

It was found that the bleaching composition removed an average of 69.0% of the stain from the swatches, whereas the control composition removed only 43.0% of the stain. The shade of the Vat Blue dyed cotton swatch showed little change, being very slightly greener than the control swatch.

LOW TEMPERATURE ACTIVATION TESTS

The 2,4-diisocyanato-6-chloro-5-triazine was also tested for its low temperature activation effectiveness. The test procedure was the same as that described for the previous tests, except that the temperature of the water in the Terg-O-Tometer was 70° F. (rather than 120° F.); also, the bleaching composition contained 0.07 grams of the activator compound, 0.18 grams of sodium perborate tetrahydrate and 1.0 grams of "Tide" detergent. As in the previous tests, a control test was also run using the aforesaid amounts of sodium perborate and detergent with no activator.

In this case, the bleaching composition removed an average of 28.6% of the stain from the swatches, whereas the control composition removed only 20.6%. Also, the shade of the Vat Blue dyed cotton swatch was unchanged.

We claim:

1. A bleaching composition comprising hydrogen peroxide or a hydrogen peroxide-releasing compound and an activating amount of a diisocyanato-s-triazine compound represented by the formula:

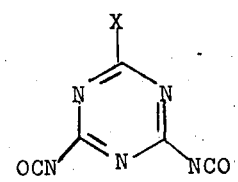

wherein X is a halogen atom.

2. A bleaching composition according to claim 1 wherein the mole ratio of the diisocyanato-s-triazine compound to the hydrogen peroxide-releasing compound is from about 1:1 to about 1:10.

3. A bleaching composition according to claim 1 wherein the hydrogen peroxide-releasing compound is sodium perborate or sodium percarbonate.

4. A bleaching composition according to claim 3 wherein the diisocyanato-s-triazine is represented by the formula:

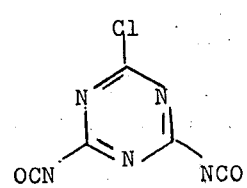

5. A bleaching composition according to claim 1 containing a detergent.

* * * * *